United States Patent [19]

Perrin

[11] 4,344,412

[45] Aug. 17, 1982

[54] LOG SUPPORTING RACK FOR USE IN A FIREPLACE

[76] Inventor: James Perrin, 3700 Prince William Dr., Fairfax, Va. 22031

[21] Appl. No.: 224,497

[22] Filed: Jan. 13, 1981

[51] Int. Cl.[3] ..... F24B 13/00

[52] U.S. Cl. ..... 126/298; 126/164; 211/60 R

[58] Field of Search ..... 126/164, 165, 152 B, 126/152 R, 201, 202, 298, 336; D7/207; 211/60 R, 49 D, 181

[56] References Cited

U.S. PATENT DOCUMENTS

| | | | |
|---|---|---|---|
| 822,743 | 6/1906 | Leveritt | 126/298 |
| 1,418,411 | 6/1922 | Ward | 126/298 |
| 1,588,954 | 6/1926 | Emmet | 126/298 |
| 2,031,732 | 2/1936 | Plym | 126/298 |

*Primary Examiner*—James C. Yeung

*Attorney, Agent, or Firm*—Mawhinney & Mawhinney & Connors

[57] ABSTRACT

A log supporting rack has a pair of structurally unconnected individual frames adapted to be arranged in selectively variable spaced apart side by side relation on the hearth of a fireplace. Each frame is formed from a one piece metal rod bent upon itself to provide a substantially Z-shaped base from the ends of which vertical sections upstand with one section being taller than the other. The vertical sections terminate in upwardly facing supporting cradles in which top rods seat with the end of each such rod at the higher vertical section being bent downwardly so as to locate the rods in inclined placement on the upper ends of the vertical sections whereby logs are positionable on the top rods so as to extend between the frames in a declined pattern over the fire from the front to the back of the hearth of a fireplace.

6 Claims, 4 Drawing Figures

LOG SUPPORTING RACK FOR USE IN A FIREPLACE

BACKGROUND OF THE INVENTION (1) Field Of The Invention

The present invention generally appertains to improvements in fireplace grates and, more particularly, relates to a new and novel rack for use in suspending logs in an inclined pattern over a burning fire in the hearth of a fireplace.

(2) State Of The Prior Art

The use of logs supporting devices for supporting logs in an inclined pattern so as to constitute the burning fire on the hearth of a fireplace is generally known.

For example, in U.S. Pat. No. 2,414,033, a plurality of parallel spaced grate bars are supported by a frame and slope downwardly to support logs above a damper plate carried by the frame with the logs constituting the burning fire on the hearth of the fireplace.

In both U.S. Pat. Nos. 177,464 and 868,168, grates in the form of baskets attached to the fireplaces for holding bundles of logs are disclosed.

In U.S. Pat. Nos. De. 235,727; 247,418 and 247,419, grates formed from connected rods are shown. Such grates are of one-piece construction and cannot support logs over a grate on a hearth without interfering with such grate that contains the burning fire.

SUMMARY OF THE INVENTION

The present invention provides a rack that, contrary to the afore-described prior art devices, is designed to suspend several logs in an inclined pattern over the burning fire on the hearth of a fireplace. More particularly, the logs are arranged in a declined pattern from the front to the back of the fireplace above the burning fire on the hearth. Thus, the heat from the fire, instead of going straight up the chimney, strikes the underside of the inclined log barrier and is deflected directly out into the room. The undersides of the suspended logs are caused to char and burn whereby these logs radiate their heat down at the main fire and, thence, into the room. As the fire progresses, coals form on the suspended logs and eventually drop onto the underlying hearth fire to increase further the intensity of such fire and, thus, the radiation of heat into the room.

The logs can be so suspended because the rack is formed from separate side frames which have no structural interconnection and which stand sturdily alone on the hearth in a selectively spaced apart side by side relation between which the suspended logs extend.

Thus, an important object to the present invention is to improve the heating efficiency of a fireplace with the log supporting rack being compatable with all types of andirons or grates and being so unobtrusive as to be barely noticeable in a fireplace.

Another object of the present invention is to provide a device for supporting logs in an inclined pattern over the fire on the hearth of a fireplace which device is composed of separable steel rods that are easily assembled without tools or fasteners into a rack.

Another important object of the present invention is to provide a fireplace log supporting rack made up of rods that can be arranged in a knocked down package for easy storage and transportation and which can be assembled together into an erect log supporting condition with no base impediment to any conventional grate on the hearth of a fireplace.

A further important object of the present invention is to provide an extremely compact, inexpensive and easily disassembled or assembled rack for supporting logs in an inclined pattern over the fire on the hearth of a fireplace.

DESCRIPTION OF THE PREFERRED EMBODIMENT

Figure 1:
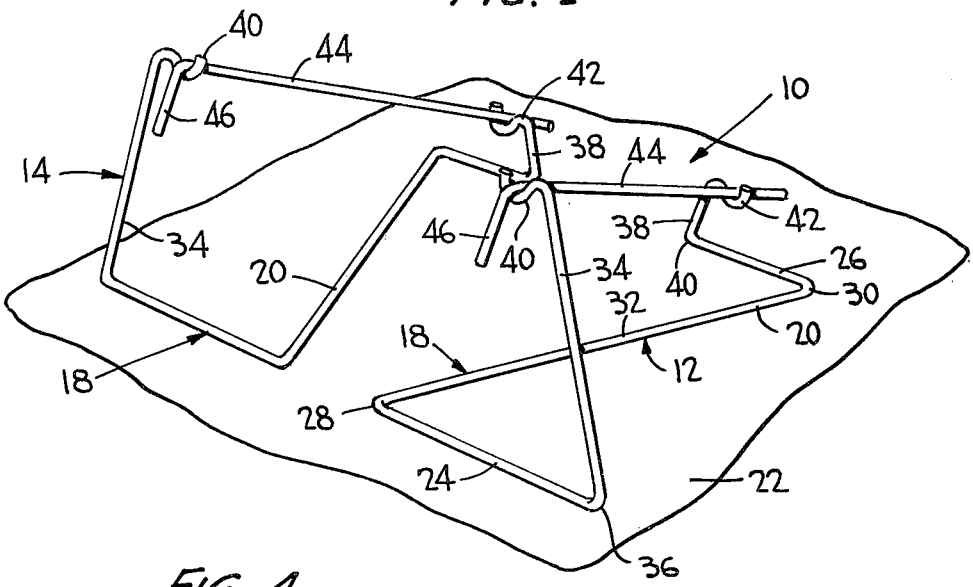
FIG. 1 is a perspective view of the log supporting rack in an assembled condition.
Figure 4:
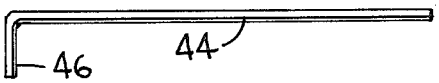
FIG. 4 is a side view of one of the top rods used in relation with each frame of the rack to constitute the supports for the logs, as shown in FIG. 2.

The log supporting rack 10, as most clearly shown in FIG. 1, includes two frames 12 and 14 of identical construction. In use, the frames are adapted to be disposed in the fireplace 16 (FIG. 2) in a structurally unconnected, side by side, spaced apart relation. The frames are formed from rods, preferably of steel, and are made in sections or parts.

Figure 2:
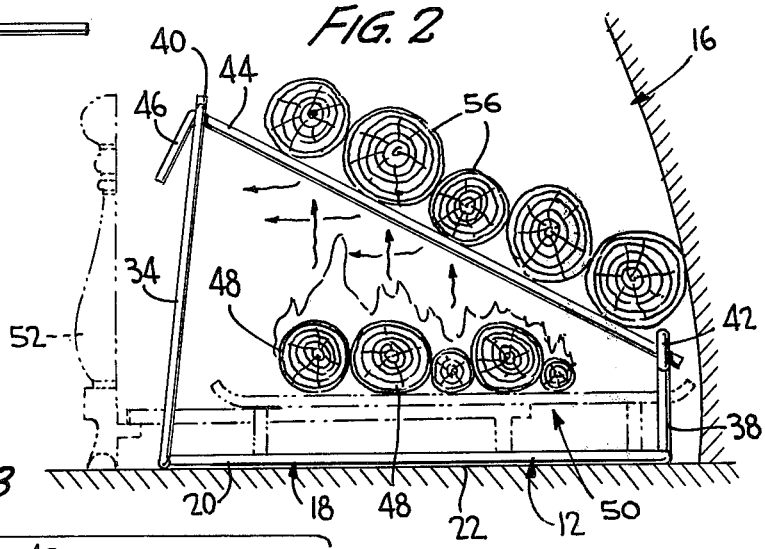
FIG. 2 is a side elevational view of the rack showing the same in place in a fireplace and showing supporting rods in a suspended inclined pattern over the burning fire on the grate on the hearth of a fireplace.
Figure 3:
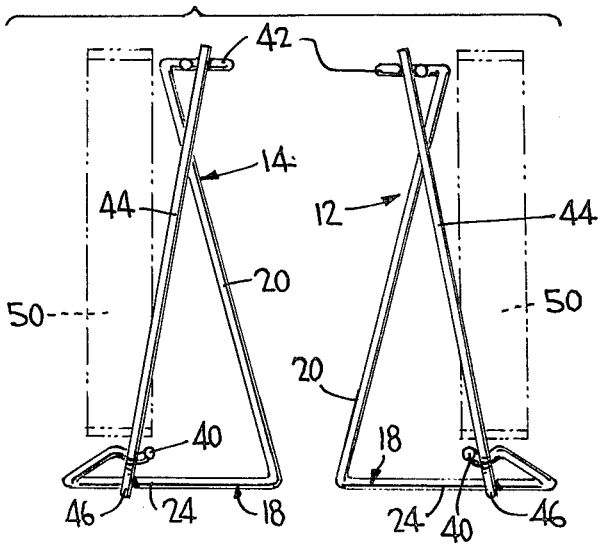
FIG. 3 is a top plan view of the rack.

The frames 12 and 14 each include a one-piece rod 18 which is bent upon itself to provide a substantially z-shaped supporting base 20 adapted to be placed flat on the hearth 22 of the fireplace, as shown in FIG. 2. The z-shaped base 20 has parallel end portions 24 and 26 connected at opposite ends 28 and 30 by an integral diagonal portion 32 with the end portion 24 constituting the front end of the base and being substantially longer than the rear end portion 26 for stabilization purposes.

A vertical leg or section 34 upstands from the opposite end 36 of the front end of the base while a vertical leg or section 38 upstands from the opposite end 40 of the rear section 26. The leg 34 is part of the front of each frame and extends considerably above the rear leg or section 38 of each frame.

The upper ends of each of the legs 34 and 38 terminate in upwardly facing laterally offset hooks or supporting cradles 40 and 42 in which a top rod 44 is seated. The rods 44 for each frame constitute the top portions of the frames and the rods are located in inclined placement as a decline from the front sections for legs 34 for each frame to the back legs or sections 38. Each of the top rods is formed at its upper front end with a downturned end portion 46 which engages the front of each supporting cradle so as to locate the top rods in the supporting cradles and prevent rear slippage thereof on the legs or vertical sections.

As can be appreciated from FIG. 1, due to the formation of the bases which adds to their stability, the supporting cradles 40 and 42 project inwardly from the upper ends of their respective legs or vertical sections so that the cradles face in opposite directions towards each other.

As shown in FIG. 2, a burning fire 48 is situated on the hearth 22 with the burning logs 48*a* being on the log cradles 50 supported by the andirons 52.

Depending upon the lengths of the logs 56 and the lengthwise extent of the fire, the independent frames 12 and 14 are located in a selected spacement in side by side relation so that the logs 56 can be supported on the top rods of the frames in an inclined pattern above the burning fire.

The rack 10 can be stored or shipped in a disassembled condition with one of the frames being inverted upon the other and the top bars being placed alongside the thusly related frames.

It can be appreciated that a very simple but sturdy and compact rack is provided for supporting logs in a deflective pattern over the burning fire on the hearth of a fireplace. Of course, it is to be understood that the rack, as described and shown, is merely exemplary of the invention which is only limited by the scope and spirit of the appended claims.

What is claimed is:

1. A rack for supporting logs in a rearwardly declined pattern over a burning fire on the hearth of a fireplace comprising a pair of frames composed of rods and being arranged in a selectively spaced part, side by side, structurally unconnected relation, single substantially z-shaped rod adapted to rest flat on the hearth and having opposing front and rear end portions and vertical sections upstanding from the base, one of said vertical sections being the front section upstanding from the front end portion of the base rod and the other being the rear section upstanding from the rear end portion of the base rod with the front section being higher than the rear section and rod members extending between and supported by said sections, wherein upon which logs can be placed in a rearwardly declined pattern above the furning fire with the logs being suspended over the burning fire to char and burn and, thus, radiate their heat both into the room and back down at the fire underneath.

2. The invention of claim 1, wherein said base rod includes parallel transverse end sections integrally connected at opposite ends by a diagonal section.

3. The invention of claim 2, wherein the vertical sections upstand integrally from the ends of the end sections opposite to the ends thereof connected by the diagonal section.

4. The invention of claim 1, wherein the upper ends of the vertical sections terminate in upwardly facing laterally offset supporting cradles in which the rod members seat.

5. The invention of claim 4, wherein means is carried by each rod member to locate the rod members in placement in the supporting cradles.

6. The invention of claim 5, wherein said rod members are in the form of straight rods and said means includes a downwardly bent end on each rod.

* * * * *